US009212414B2

(12) United States Patent
Parrella et al.

(10) Patent No.: US 9,212,414 B2
(45) Date of Patent: Dec. 15, 2015

(54) MENISCUS COATING APPARATUS AND METHOD

(75) Inventors: Larry E. Parrella, Middletwon, OH (US); Paul V. Janavicius, Wyoming, OH (US); George A. Paraskos, Mason, OH (US)

(73) Assignee: AK Steel Properties, Inc., West Chester, OH (US)

( * ) Notice: Subject to any disclaimer, the term of this patent is extended or adjusted under 35 U.S.C. 154(b) by 342 days.

(21) Appl. No.: 13/479,382

(22) Filed: May 24, 2012

(65) Prior Publication Data

US 2012/0301623 A1 Nov. 29, 2012

Related U.S. Application Data

(60) Provisional application No. 61/490,862, filed on May 27, 2011.

(51) Int. Cl.
*C23C 2/40* (2006.01)
*C23C 2/00* (2006.01)

(52) U.S. Cl.
CPC .. *C23C 2/003* (2013.01); *C23C 2/40* (2013.01)

(58) Field of Classification Search
CPC ..... C23C 2/003; C23C 2/02; C23C 2/40; C23C 26/02; B05D 1/26; B05D 7/14
See application file for complete search history.

(56) References Cited

U.S. PATENT DOCUMENTS

| | | | | |
|---|---|---|---|---|
| 2,159,297 | A * | 5/1939 | Shover | 118/65 |
| 2,681,294 | A | 6/1954 | Beguin | |
| 2,914,419 | A | 11/1959 | Oganowski | |
| 2,914,423 | A | 11/1959 | Knapp | |
| 3,272,176 | A | 9/1966 | Saydlowski | |
| 3,605,863 | A | 9/1971 | King | |
| 3,965,857 | A | 6/1976 | Baxter | |
| 4,069,358 | A | 1/1978 | Winter et al. | |
| 4,082,868 | A | 4/1978 | Schnedler et al. | |
| 4,137,347 | A | 1/1979 | Graff et al. | |
| 4,169,426 | A | 10/1979 | Kornmann et al. | |
| 4,191,127 | A | 3/1980 | Herman | |
| 4,207,831 | A | 6/1980 | Wald et al. | |
| 4,431,688 | A | 2/1984 | Kornmann | |
| 4,475,583 | A | 10/1984 | Ames | |
| 4,490,418 | A | 12/1984 | Yoshida | |
| 4,529,628 | A | 7/1985 | Haour et al. | |

(Continued)

FOREIGN PATENT DOCUMENTS

| | | | |
|---|---|---|---|
| EP | 0168986 | | 1/1986 |
| JP | 54119340 A | * | 9/1979 |
| JP | 2004204327 | | 7/2004 |

OTHER PUBLICATIONS

Ellen, C.H., et al., "An Analysis of Jet Stripping of Molten Metallic Coatings", Eight Australasian Fluid Mechanics Conference, University of Newcastle, N.S.W., Nov. 28-Dec. 2, 1983, pp. 2C.4-2C.7.

(Continued)

*Primary Examiner* — David Turocy
(74) *Attorney, Agent, or Firm* — Frost Brown Todd LLC

(57) ABSTRACT

A meniscus coating apparatus and method for coating at least one surface of a metal strip includes an apparatus having an adjustable coating tray, a roll enclosure disposed adjacent the coating tray, an adjustable baffle, and/or a gas delivery device operable to help seal the roll enclosure.

10 Claims, 7 Drawing Sheets

(56) References Cited

U.S. PATENT DOCUMENTS

| | | | | | |
|---|---|---|---|---|---|
| 4,751,957 | A | | 6/1988 | Vaught | |
| 4,973,500 | A | | 11/1990 | Ishii et al. | |
| 5,077,094 | A | | 12/1991 | McCall et al. | |
| 5,339,329 | A | | 8/1994 | Flinchum et al. | |
| 5,399,376 | A | | 3/1995 | Flinchum et al. | |
| 5,443,638 | A | | 8/1995 | Gartmann et al. | |
| 5,453,127 | A | * | 9/1995 | Flinchum et al. | 118/63 |
| 5,612,092 | A | | 3/1997 | Strenger et al. | |
| 5,688,324 | A | | 11/1997 | Umaba | |
| 5,705,228 | A | | 1/1998 | Kornmann | |
| 5,785,772 | A | | 7/1998 | Deka | |
| 5,855,238 | A | | 1/1999 | Pleschiutschnigg et al. | |
| 5,935,653 | A | | 8/1999 | Rasmussen | |
| 6,093,452 | A | * | 7/2000 | Ishii et al. | 427/433 |
| 6,224,692 | B1 | | 5/2001 | Cantacuzene | |
| 6,491,770 | B1 | | 12/2002 | Knott, Sr. | |
| 6,733,721 | B2 | | 5/2004 | Knott, Sr. | |
| 6,761,935 | B2 | | 7/2004 | Sanchez et al. | |
| 7,329,437 | B2 | | 2/2008 | Kanke et al. | |
| 7,867,567 | B2 | | 1/2011 | Hasegawa et al. | |
| 2006/0024445 | A1 | | 2/2006 | Willnow et al. | |

OTHER PUBLICATIONS

International Search Report dated Oct. 15, 2012 for Application No. PCT/US2012/039286.

International Written Opinion dated Oct. 15, 2012 for Application No. PCT/US2012/039286.

English Abstract of Japanese Patent Application No. JP 2004204327.

* cited by examiner

MENISCUS COATING APPARATUS AND METHOD

PRIORITY

This application claims priority to U.S. Provisional Patent Application Ser. No. 61/490,862, filed May 27, 2011, entitled "BAFFLE SYSTEM FOR MENISCUS COATING APPARATUS," the disclosure of which is incorporated by reference herein.

BACKGROUND

The corrosion resistance of a metal strip can be enhanced by coating the strip with molten metal, such as zinc. It has been known to anneal the metal strip, prepare the surface of the metal strip for coating in a protective atmosphere maintained in an enclosure, and then immerse the metal strip in a bath of molten metal to coat the metal strip with the molten metal.

Immersion baths may not guarantee consistent product quality of the metal strip. For example, changes in the surface condition of pot rolls directing the metal strip through the bath can cause negative effects on the metal strip such as marks or scratches, as well as nonuniform coating thickness formation. Further, immersion bath methods often require a large molten metal reservoir that, with the pot rolls, is costly to manufacture and maintain.

Meniscus coating methods are known, as disclosed in U.S. Pat. No. 5,453,127, entitled "Apparatus for Meniscus Coating a Metal strip," issued Sep. 26, 1995, and U.S. Pat. No. 5,399,376, entitled "Meniscus Coating Metal strip," issued Mar. 21, 1995, which patents are incorporated by reference herein. The metal strip is treated (for example, the metal strip is heated in a furnace, or heated and cooled, to achieve a temperature near a melting point of a coating metal prior to the metal strip being coated with the coating metal). After such treatment, the metal strip passes through a protective, often non-oxidizing, atmosphere contained within an enclosure to arrive at a coating tray holding a pool of molten coating metal. The metal strip typically passes close to the pool of molten metal and surface tension bridges the gap between the molten metal surface and the metal strip, allowing the molten metal to coat the strip.

The present application describes a meniscus coating apparatus that provides for coating of the strip outside of the protective enclosure by minimizing the ingress of ambient air into the enclosure containing the protective atmosphere.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings, in which like reference numerals identify the same elements and in which:

Figure 1:
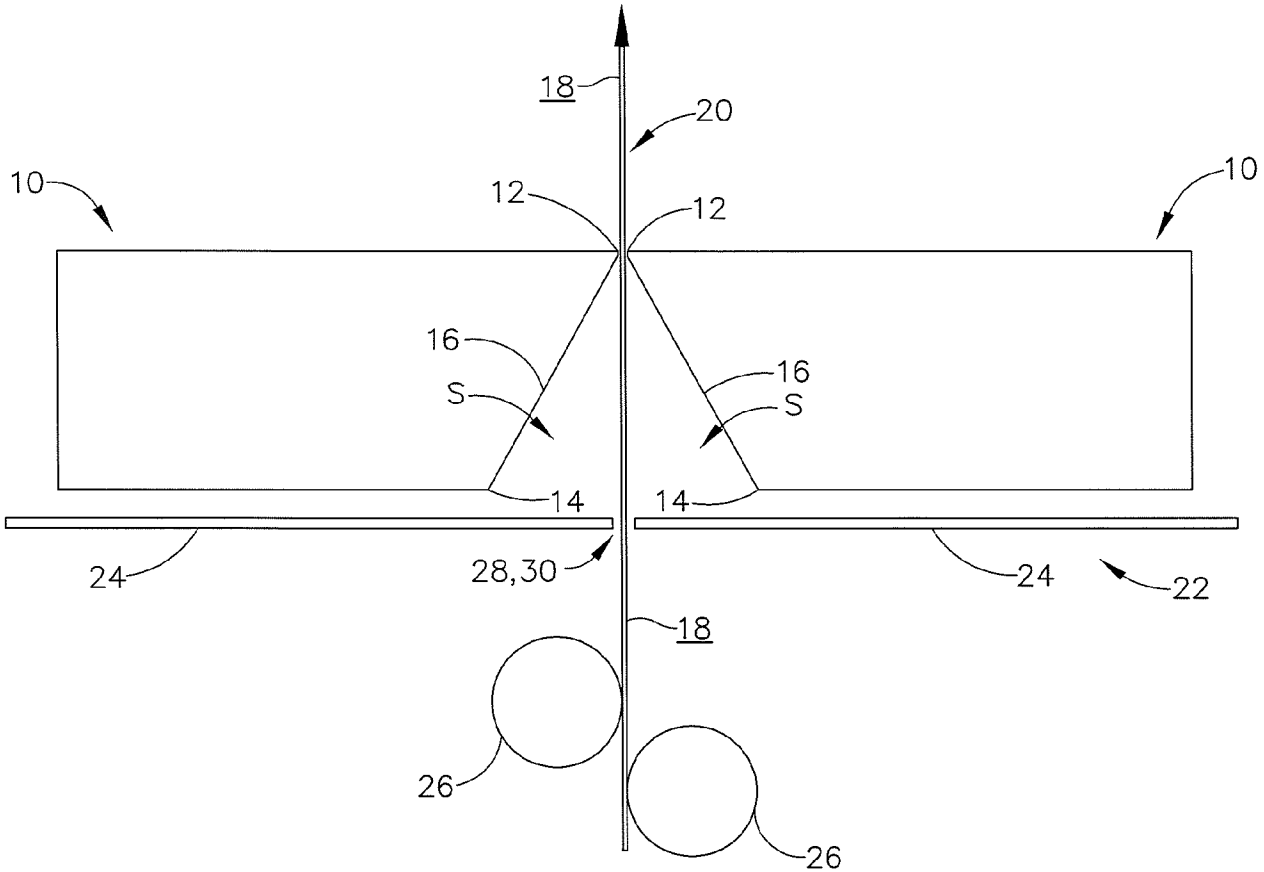
FIG. 1 depicts an elevation view of an exemplary meniscus coating apparatus.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples of the invention should not be used to limit the scope of the present invention. Other examples, features, aspects, embodiments, and advantages of the invention will become apparent to those skilled in the art from the following description. As will be realized, the invention is capable of other different and obvious aspects, all without departing from the invention. Accordingly, the drawings and descriptions should be regarded as illustrative in nature and not restrictive.

As disclosed in U.S. Pat. Nos. 5,453,127 and 5,399,376, which patents are incorporated by reference above, a metal strip is advanced through a meniscus coating apparatus to be coated with molten metal. Before coating, the metal strip must be clean and free of any oxides or other materials that may adversely affect coating adherence. Such surface preparation and treatment is well known in the art. With respect to temperature, the metal strip may be heated in a furnace, or heated in a furnace and then cooled, to achieve a desired temperature, as is also well-known in the art.

As the metal strip approaches coating, this prepared condition must be maintained. This can be done by enclosing the prepared strip in a roll enclosure with a specialized, protective atmosphere as is well known in the art, and is described in U.S. Pat. No. 5,435,127. The roll enclosure may be a substantially enclosed chamber that houses the coating trays in a protective environment along with shaping rolls, which help to maintain the shape of the strip prior to coating. The metal strip advances past the coating trays to be coated with molten metal within the enclosure.

According to an embodiment of the present disclosure, a coating tray of a meniscus coating apparatus is disposed outside of a roll enclosure. The present disclosure describes embodiments of a meniscus coating apparatus that maintains a protective atmosphere within a roll enclosure, while the coating tray is disposed outside of the roll enclosure. The meniscus coating apparatus of the present disclosure includes physical or pressurized gas barriers that allow the strip to exit the enclosure while minimizing the ingress of ambient air into the roll enclosure, as described below. Further, the described physical or pressurized gas barriers aid in maintaining a protective atmosphere, in particular they assist in maintaining an oxygen-free, or at least substantially oxygen-free, environment, around the strip after it exits the enclosure and until the molten metal coating is applied to it.

The coating tray includes a top lip that delivers a coating metal in a molten phase to a surface of a metal strip. Meniscus coating trays are well-known in the art, and suitable trays include those described in U.S. Pat. Nos. 5,453,127 and 5,399,376, among others. The strip may comprise carbon steel, stainless steel, or any other suitable metal strip. The coating metal may comprise zinc, aluminum, zinc magnesium, tin, terne (including lead and tin), or other suitable coating metals, as is known in the art.

The metal strip is advanced toward the coating tray through a cover of a roll enclosure. In particular, the metal strip is advanced through a strip receiving portion of an aperture in the cover of the roll enclosure, as described further below. The aperture in the cover of the roll enclosure includes at least one open portion that does not receive the metal strip. The aperture may extend completely or partially between edges of the cover.

An adjustable plate or baffle, further described below, is adapted to cover all or part of the open portion of the aperture in the cover. The baffle may be disposed within the roll enclosure or outside of the roll enclosure, such as on top of the cover. One or more seals may be disposed between the baffle and the coating tray, or between the coating tray and the cover of the roll enclosure. Isolation of an area between the coating lips of the coating trays and the cover by a baffle and/or seals may permit the development of a positive gas pressure in that area that allows the distance between the coating lips and the strip to be greater. For example, unsupported molten metal in the meniscus bows downward via a downward pull that is a balance between gravity and surface tension. For a given surface tension, there is a maximum lip to strip distance before the meniscus will fall, or escape from the bow formation and drop downwards following a gravitational pull, as the surface tension would no longer be high enough to retain the molten metal. An increase of pressure below the meniscus can counteract gravity to allow for a larger lip to strip distance. Regulating the pressure may allow the meniscus coating process to be started at a low pressure and ramp up the pressure as the lip to strip distances increases. Larger lip to strip distances may allow for an increased amount of strip shape variation possibilities, for example.

Referring to FIG. 1, a pair of horizontally disposed coating trays (10) is shown. While a pair of coating trays (10) is shown, an embodiment of the present disclosure may include a single coating tray (10). Each coating tray (10) includes top lip (12), bottom edge (14), and lip adjacent sidewall (16) that extends between top lip (12) and bottom edge (14). Top lip (12) and/or coating tray (10) comprises a ceramic, a plastic ceramic, metal, a non-wetting material, and/or other suitable material and combinations thereof. Coating tray (10) may be heated via gas burners and/or induction heating. Each top lip (12) is able to coat at least one surface (18) of metal strip (20) with a coating metal. When metal strip (20) passes next to coating tray (10), surface tension bridges a gap between the molten metal at top lip (12) and metal strip (20) to coat metal strip (20) with the coating metal. As will be understood by those of skill in the art, other coating tray configurations can also be used in the coating apparatus.

The coating metal comprises a molten metal, such as zinc, aluminum, tin, and/or terne metal (including lead and tin), or other molten metal usable to coat a metal strip. Suitable coating metals are well-known in the art. In the event that more than one coating tray is used, each coating tray may contain the same coating metal, or a different coating metal, such that different coating metals are applied on opposite sides of metal strip (20). A first surface (18) of the metal strip (20) may be coating with a first coating metal, and a second opposite surface (18) may be coated with a second coating metal. For example, one side of metal strip (20) may be coated with a tin coating and another side of metal strip (20) may be coated with a zinc or terne metal coating.

Referring to FIG. 1, roll enclosure (22) having cover (24) is disposed adjacent and below coating trays (10), which can be spaced apart at different distances. A positioning device, as is apparent to one of ordinary skill in the art in view of the teachings herein, may be used to adjust coating trays (10) into a desired position. The distance between top lips (12) should be at least sufficient to allow for passage of metal strip (20) while providing the meniscus coating of surfaces (18) of metal strip (20) via top lips (12).

Disposed within roll enclosure (22) may be at least one roll (26). A pair of rolls (26) is shown in the embodiment of FIG. 1 to be disposed before and below cover (24) of roll enclosure (22). Roll (26) is configured to shape and/or flatten metal strip (20) as it moves past the rolls (26) toward cover (24) of roll enclosure (22) and toward coating trays (10). Such shaping rolls are well-known in the art.

Figure 2:
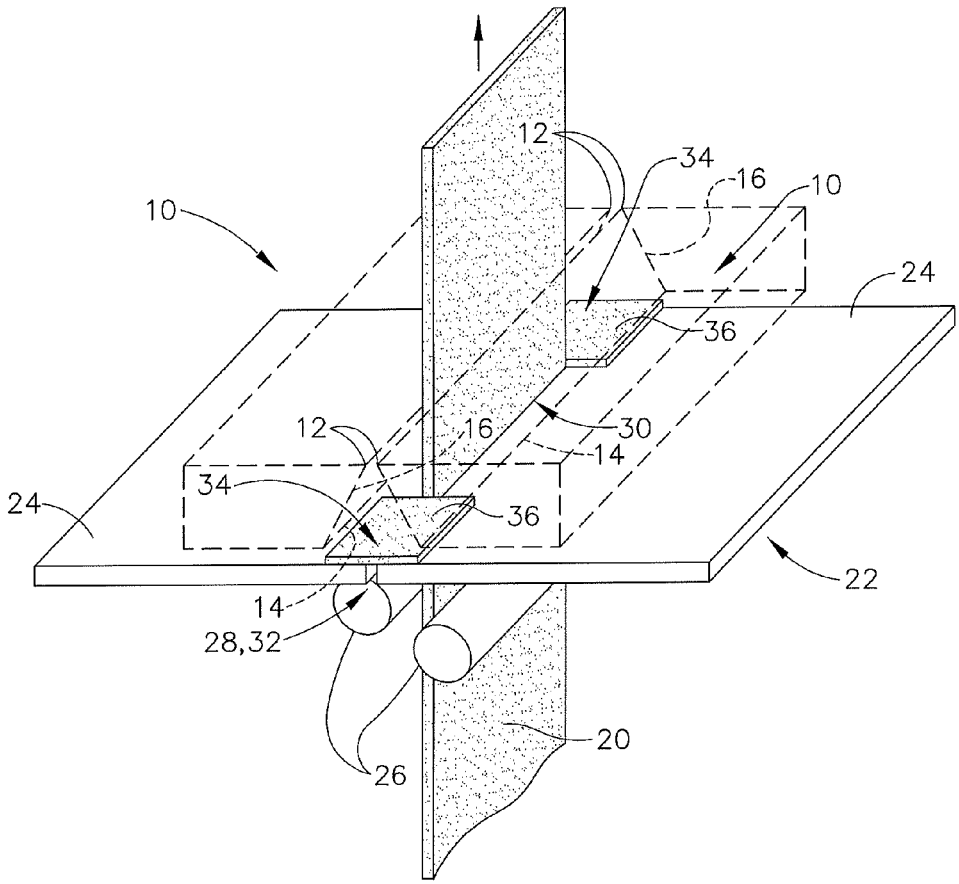
FIG. 2 depicts a perspective view of the exemplary coating apparatus of FIG. 1 and includes a first exemplary pair of baffles.

Cover (24) of roll enclosure (22) includes aperture (28). A portion of aperture (28) in cover portion (24) may be covered by baffles, as described below, to minimize ingress of air into roll enclosure (22) near steel strip (20) or to minimize contact of the steel strip with the ambient atmosphere prior to coating. Aperture (28) includes strip receiving portion (30), which is that portion of the aperture (28) occupied by the metal strip (20) during coating, and at least one open portion (32), which is any portion of the aperture (28) not occupied by the metal strip (20) during coating (FIG. 2). Referring back to FIG. 1, strip receiving portion (30) is sized and shaped to receive metal strip (20). Metal strip (20) has a strip width and thickness, and aperture (28) has an aperture width and thickness that is greater than the strip width and thickness of metal strip (20) such that the entirety of aperture (28) does not receive metal strip (20) and only strip receiving portion (30) receives metal strip (20). Any open portion (32) does not receive a portion of metal strip (20).

At least one adjustable plate or baffle (34) may be disposed to cover some or all of an open portion (32). Baffle (34) may be manually and/or automatically adjusted into a desired position via, for example, edge sensing systems such as those provided by EMG-Automation GmbH, D-57482 Wenden, Germany; Keyence Corporation, Itasca, Ill.; FMS Force Measuring Systems AG, Hoffman Estates, Ill.; and Microsonic GmbH, 44227 Dormund, Germany; and as will be apparent to one of ordinary skill in the art in view of the teachings herein.

Referring to FIG. 2, open portions (32) surround strip receiving portion (30) that receives metal strip (20). A baffle (34) is disposed over the open portions (32). The baffles (34) prevent substantial leakage of ambient air into roll enclosure (22) via open portions (32) of cover (24) of roll enclosure (22) and help to provide positive pressure within a space (S) defined below top lips (12) of coating trays (10) and cover (24).

Figure 3:
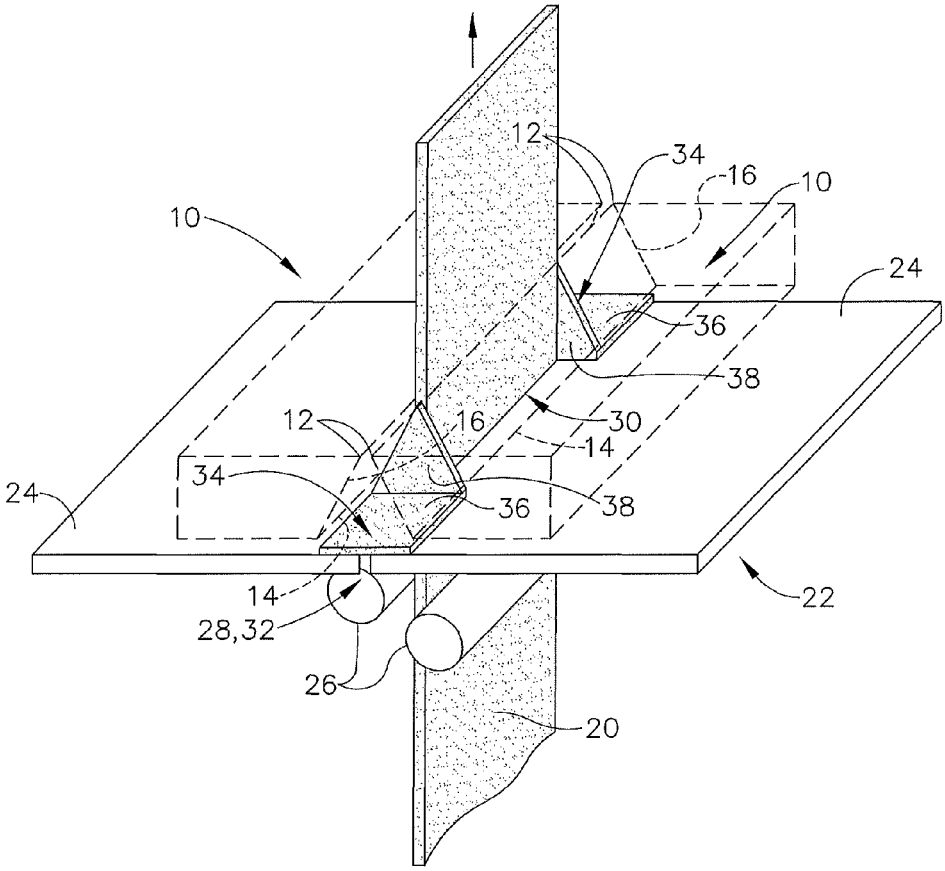
FIG. 3 depicts a perspective view of the exemplary coating apparatus of FIG. 1 and includes a second exemplary pair of baffles.

FIG. 2 shows an embodiment of baffle (34) including flat portion (36). Flat portion (36) is disposed over open portion (32) of aperture (28) of cover (24) of roll enclosure (22). FIG. 3 shows another embodiment of baffle (34) including flat portion (36) and sidewall portion (38). Flat portion (36) includes interior edge (40) that faces strip receiving portion (30), and sidewall portion (38) upwardly extends from interior edge (40) to abut against a side edge of metal strip (20) as it is received through strip receiving portion (30) of aperture (28). Sidewall portion (38) is sized to seal against lip adjacent sidewall (16) of each coating tray (10) via baffle sidewall edge (40). Baffle sidewall edge (40) may comprise a flexible material such as a refractory fiber cloth that assists to seal baffle sidewall edge (40) against lip adjacent sidewall (16). Alternatively, sidewall portion (38) may be similar to the shape of lip adjacent sidewall (16) and allow for a clearance to permit a desired positioning of each coating tray (10).

Figure 4:
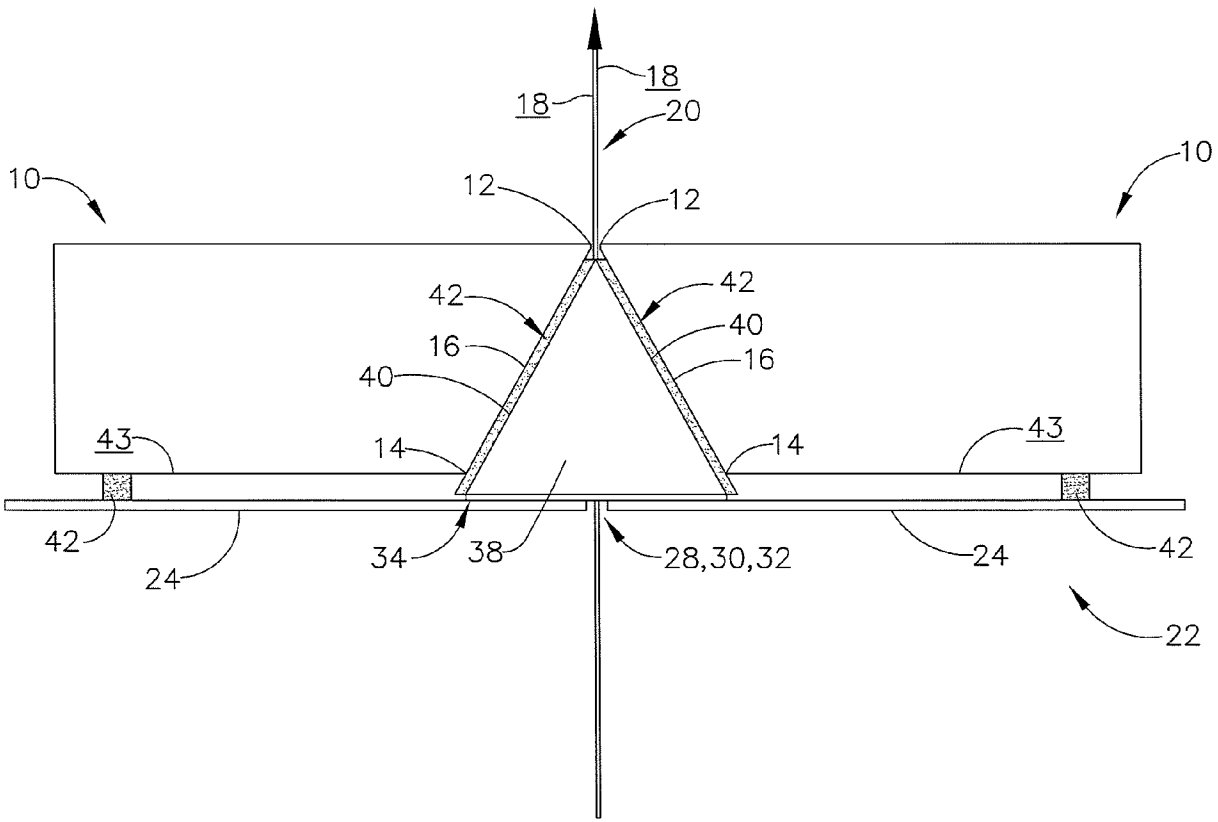
FIG. 4 depicts an elevation view of an exemplary baffle with a plurality of seals.

Additionally or alternatively, as shown in FIG. 4, a plurality of seals (42) may be disposed between cover (24) of roll enclosure (22) and top lips (12) of coating trays (10). Seals (42) are shown to be disposed below top lips (12) of coating trays (10), each seal (42) disposed between baffle sidewall edge (40) and lip adjacent sidewall (16) of each coating tray (10).

Each coating tray (10) may include surface (43) such that a second seal (42) may be disposed between surface (43) and cover (24) of roll enclosure (22). For example, as shown in FIG. 4, second seals (42) are disposed between surface (43) of each coating tray (10), wherein surfaces (43) are shown as an undersurface of coating trays (10), and a top surface of cover (24) of roll enclosure (22).

In addition to the physical barriers described above, or alternatively, a gas barrier may be used to help to seal the enclosure. A gas delivery device may be disposed on the coating apparatus before the top lip of the coating tray generally proximate to the cover of the roll enclosure. The gas delivery device operates to deliver a gas, such as nitrogen, in the area of the coating apparatus prior to the coating of the metal strip. This delivery of a gas can build a positive pressure about the pre-coated metal strip. In this way, it can assist with providing or maintaining a protective atmosphere about the pre-coated metal strip and thereby minimize effects of ambient atmosphere on the pre-coated metal strip. The gas delivery device may additionally deliver other suitable gases, such as hydrogen, to improve heat transfer properties and/or to induce chemical reactions on the metal strip prior to the coating of the metal strip. For example, the gas delivery device may deliver nitrogen and low levels of hydrogen that are below an explosive limit and in a sufficient amount to allow for heat transfer improvements and to react with oxygen that is present before and upstream of the top lip of the coating tray. The composition and effects of various desirable gases is known to those of skill in the art of coating metal strip.

The gas delivery device may also help to solidify any excess coating metal and minimize the negative effects of any drips of molten metal from the coating lips. For example, when the gas delivery device is disposed below the top lip of the coating tray, the stream of gas from the gas delivery device can freeze any drips of coating metal that may escape from the metal strip and drop downwards toward the roll enclosure. Without the gas delivery device, molten metal may drip onto the shaping rolls (26) and freeze onto these rolls, ultimately causing them to stop operation. If the gas delivery devices freeze the molten metal, this can help to prevent, or at least minimize, this plating of the coating metal onto the rolls.

Figure 5:
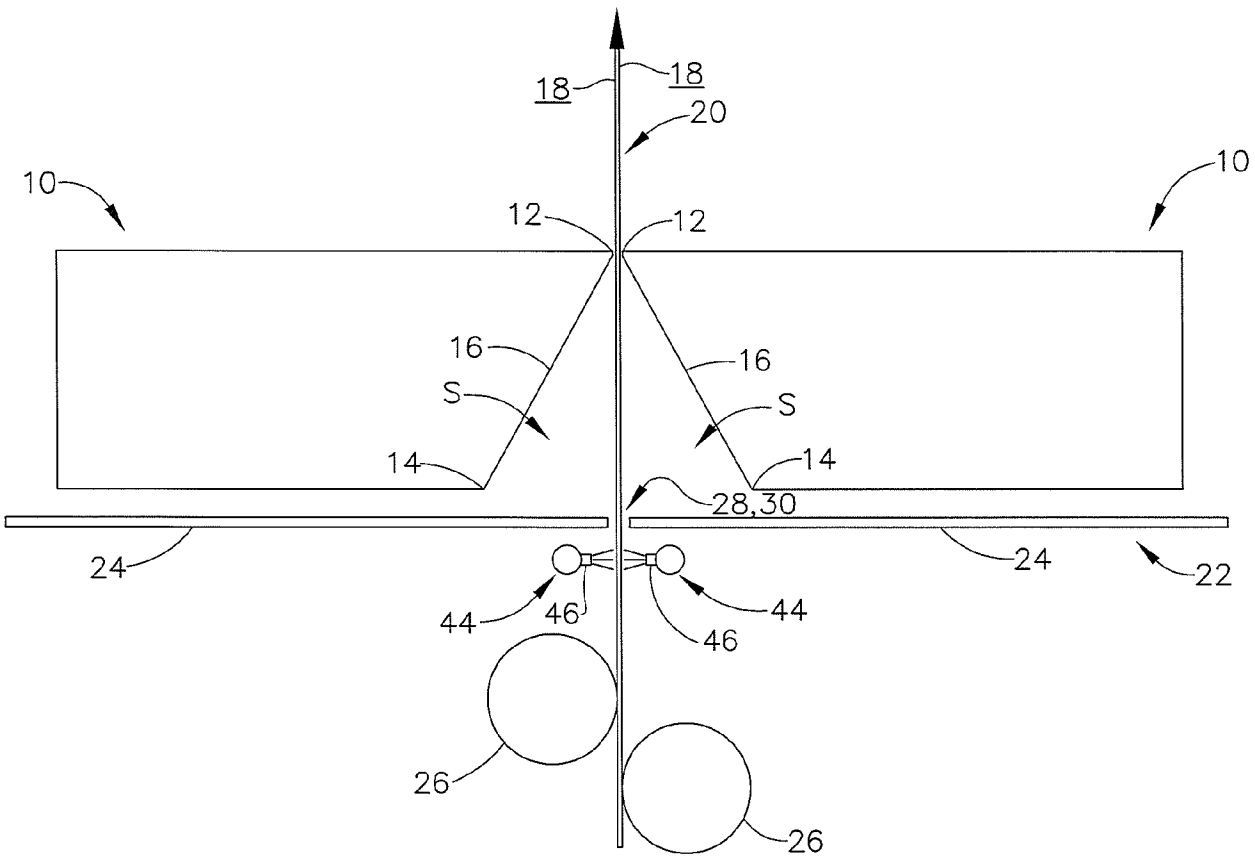
FIG. 5 depicts an elevation view of the apparatus of FIG. 1 and includes a first exemplary pair of gas delivery devices.

At least one gas delivery device (44), as shown in FIG. 5, can be located in the coating apparatus after the shaping rolls (if they are being used) and before top lip (12) of coating tray (10). Gas delivery device (44) may be used together with one or more baffle (34). Alternatively, either gas delivery device (44) or baffle (34) may be used upstream of top lip (12) of coating tray (10) to assist with preventing oxygen leakage into an area around uncoated metal strip (20) and/or to capture and/or solidify escaping molten coating metal thereby minimizing escaping coating metal dropping through aperture (28) toward the rolls (26).

Figure 6:
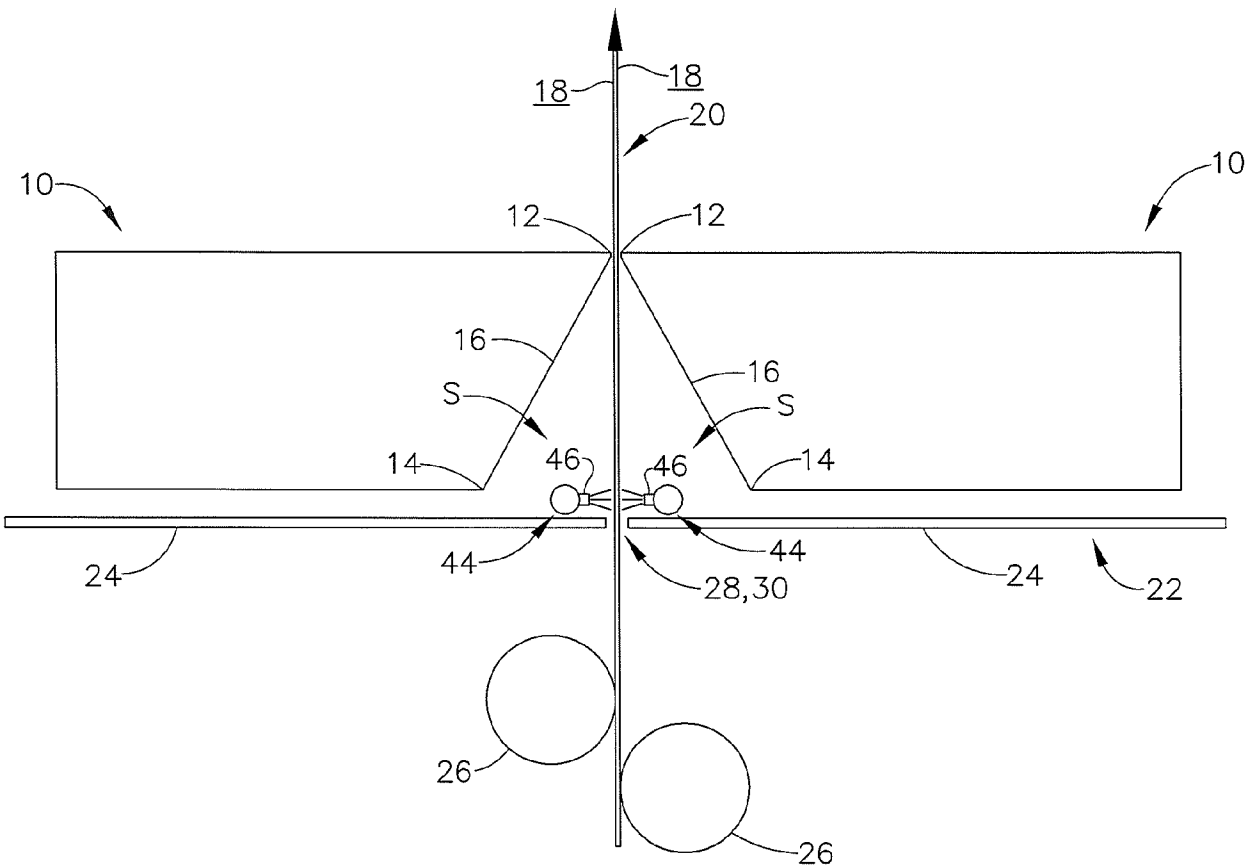
FIG. 6 depicts an elevation view of the apparatus of FIG. 1 and includes a second exemplary pair of gas delivery devices.
Figure 7:
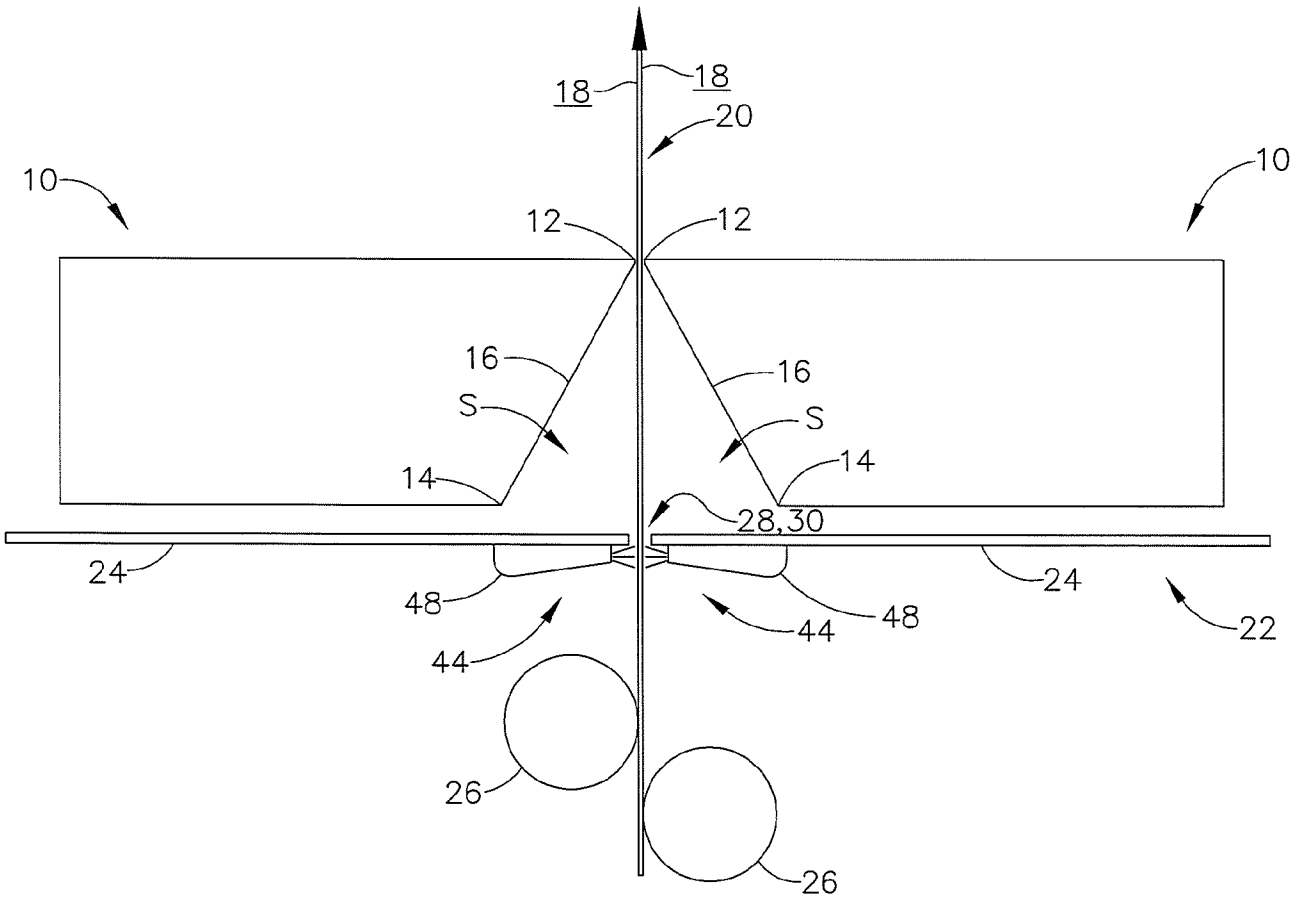
FIG. 7 depicts an elevation view of the apparatus of FIG. 1 and includes a third exemplary pair of gas delivery devices.

Gas delivery device (44) may comprise a pipe and nozzle assembly (46), as shown in FIGS. 5-6, or a plenum (48), as shown in FIG. 7 and described further below. Gas delivery device (44) is operable to deliver a gas, such as nitrogen or other suitable gas, to help maintain positive gas pressure near an area about aperture (28) to provide a more controlled atmosphere within roll enclosure (22) and substantially within space (S) disposed below top lips (12).

FIG. 5 shows a gas delivery device (44) as a pipe and nozzle assembly (46) disposed between the rolls (26) and cover (24) of roll enclosure (22). In particular, the pipe and nozzle assembly (46) is disposed below and upstream of cover (24) of roll enclosure (22) and above and downstream of the rolls (26).

FIG. 6 shows pipe and nozzle assemblies (46) disposed between top lips (12) of coating trays (10) and cover (24) of roll enclosure (22). In particular, the pipe and nozzle assembly (46) is disposed in space (S) below and upstream of top lips (12) and above and downstream of cover (24) of roll enclosure (22). The pipe connection of pipe and nozzle assemblies (46) may be spaced away from or mounted to cover (24) of roll enclosure (22).

FIG. 7 shows another embodiment of gas delivery devices (44) including plenums (48). Each plenum (48) acts as a positive pressure chamber to advance gas, such as nitrogen and as described above, toward an uncoated surface (18) of metal strip (20). Plenums (48) may be spaced away from or mounted to cover (24) of roll enclosure (22). FIG. 6 shows the plenums (48) mounted to an undersurface of cover (24) such that the plenums (48) is disposed upstream of cover (24).

In operation, metal strip (20) is treated, as described above, to achieve the desired condition, such as an oxide free, clean state. Metal strip (20) is then advanced into roll enclosure (22) and may be shaped by a pair (or more) of rolls (26). When in roll enclosure (22), the condition of metal strip (20) is maintained as roll enclosure (22) includes a protective atmosphere about metal strip (20). Metal strip (20) advances through aperture (28) toward top lip (12) of coating tray (10) to allow one or both surface(s) (18) of metal strip (20) coated with coating metal as described above. Physical and/or air pressure barriers, such as baffle (34) and/or gas delivery device (44), are positioned between top lip (12) and the rolls (26) to assist with maintaining a substantially oxygen-free environment about pre-coated metal strip (20) both within roll enclosure (22) and before coating, preventing ambient air from leaking in through aperture (28) into roll enclosure (22), and minimizing the effect of ambient atmosphere on pre-coated metal strip (20) after metal strip (20) advances from aperture (28) of roll enclosure (22) toward top lip (12) of coating tray (10).

For example, flat portions (36) of baffles (34) are disposed over open portions (32) of aperture (28). Baffles (34) may additionally include sidewall portions (38) that seal against lip adjacent sidewall (16) of coating tray (10). Baffles (34) seal some or all of open portions (32) of aperture (28) to prevent ambient air/oxygen from leaking into the protected environment within roll enclosure (22). As metal strip (20) advances through aperture (28) and past baffles (34) toward top lip (12) of coating tray (10), sidewall portions (38) seal against side edge portions of advances metal strip (20).

Additionally or alternatively, as described above, gas delivery devices (44) such as pipe and nozzle assemblies (46) or plenums (48) are disposed proximate to cover (24) of roll enclosure (22) and between top lip (12) and rolls (26). As metal strip (20) advances past the rolls (26) and before it is coated via top lip (12), gas delivery devices (44) deliver a gas such as nitrogen to metal strip (20), assisting to maintain the clean, oxide-free state of metal strip (20). Additionally, if upper portions of metal strip (20) have already been coated with coating metal and portions of that coating metal escape and drip down toward roll enclosure (22) in a molten state, for example, gas delivery devices (44) may assist to solidify the molten coating metal and prevent molten metal from passing into roll enclosure (22) to potentially affect the operation of the rolls (26).

Metal strip (20) advances to top lip (12), which contains a sufficient amount of coating metal to, via surface tension, adhere to and coat surface (18) of metal strip (20). The thickness of molten metal coating on metal strip (20) may be further adjusted by, for example, jet nozzles as described in U.S. Pat. No. 5,453,127, incorporated by reference above.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometries, materials, dimensions, ratios, steps, and the like discussed above are illustrative. Accordingly, the scope of the present invention should be considered in terms of the following claims and is understood not to be limited to the details of structure and operation shown and described in the specification and drawings.

We claim:

1. A method for meniscus coating in an ambient atmosphere at least one surface of a metal strip having a sidewall edge, the method comprising the steps of:

(a) providing:

(i) at least one horizontally disposed coating tray, wherein the at least one coating tray comprises a top lip and a lip adjacent sidewall, (ii) a roll enclosure containing a protective atmosphere, wherein the roll enclosure is disposed adjacent the at least one coating tray, wherein the roll enclosure comprises a cover such that a space is defined between the top lip and the cover, wherein the cover comprises an aperture, and the aperture comprises a strip receiving portion and at least one open portion, and (iii) at least one baffle, wherein the at least one baffle:

a. substantially covers the at least one open portion of the aperture; and b. is adjusted to develop in the space a positive pressure relative to the ambient atmosphere;

(b) advancing the metal strip through the aperture of the cover of the roll enclosure;

(c) advancing the metal strip toward the top lip of the at least one coating tray;

(d) maintaining a coating metal on the top lip of the at least one coating tray; and (e) coating the at least one surface of the metal strip with the coating metal when the metal strip advances past the top lip of the at least one coating tray.

2. The method of claim 1, further comprising receiving and shaping the metal strip via at least one roll, wherein the at least one roll is disposed within the roll enclosure.

3. The method of claim 1, further comprising:

(a) providing at least one gas delivering device;

(b) delivering a gas via the at least one gas delivering device, wherein the at least one gas delivering device is disposed proximate to the cover of the roll enclosure.

4. The method of claim 1, wherein the at least one baffle further comprises:

(a) a flat portion disposed over the at least one open portion of the aperture, wherein the flat portion has an interior edge that faces the strip receiving portion; and (b) a sidewall portion that upwardly extends from the interior edge to abut against the sidewall edge of the metal strip as it is received through the strip receiving portion of the aperture.

5. The method of claim 4, wherein the sidewall portion is sealed against the lip adjacent sidewall of the coating tray.

6. The method of claim 1, wherein the coating tray comprises an undersurface, the method further comprising the step of forming a seal between the undersurface of the coating tray and the cover of the roll enclosure.

7. A method for meniscus coating in an oxidizing atmosphere two opposed surfaces of a metal strip, wherein the metal strip comprises a first sidewall edge and a second sidewall edge and at least one surface of the metal strip is oxidizable, the method comprising:

(a) providing in the oxidizing atmosphere:

(i) a first horizontally disposed coating tray comprising a first top lip and a first lip adjacent sidewall; and (ii) a second horizontally disposed coating tray comprising a second top lip and a second lip adjacent sidewall;

(ii) a roll enclosure having a non-oxidizing atmosphere, wherein the roll enclosure:

1. comprises a cover having an aperture, the aperture comprising:

a. a strip receiving portion;

b. a first open portion; and c. a second open portion; and 2. is disposed beneath the first and second horizontally disposed coating trays such that a space is defined between the first top lip, first lip adjacent sidewall, second top lip, second lip adjacent sidewall and the cover of the roll enclosure;

(iii) a first baffle comprising:

1. a flat portion disposed over the first open portion of the aperture, wherein the flat portion has an interior edge that faces the strip receiving portion of the aperture; and 2. a sidewall portion that upwardly extends from the interior edge to abut against the first sidewall edge of the metal strip as it is received through the strip receiving portion of the aperture, wherein the sidewall portion is sealed against the first lip adjacent sidewall of the first coating tray, (iv) a second baffle comprising:

1. a flat portion disposed over the second open portion of the aperture, wherein the flat portion has an interior edge that faces the strip receiving portion of the aperture; and 2. a sidewall portion that upwardly extends from the interior edge to abut against the second sidewall edge of the metal strip as it is received through the strip receiving portion of the aperture, wherein the sidewall portion is sealed against the second lip adjacent sidewall of the second coating tray;

wherein the first and second baffles are adjusted to maintain the non-oxidizing atmosphere of the roll enclosure in the space;

(b) advancing the metal strip through the aperture of the cover of the roll enclosure;

(c) advancing the metal strip toward the first top lip and the second top lip;

(d) maintaining a coating metal on the first top lip and the second top lip; and (e) coating the two opposed surfaces of the metal strip with the coating metal when the metal strip advances past the first top lip and the second top lip into the oxidizing atmosphere.

8. The method of claim 7, further comprising receiving and shaping the metal strip via at least one roll, wherein the at least one roll is disposed within the roll enclosure.

9. The method of claim 7, further comprising:

(a) providing at least one gas delivering device;

(b) delivering a gas via the at least one gas delivering device, wherein the at least one gas delivering device is disposed proximate to the cover of the roll enclosure.

10. The method of claim 7, wherein the coating tray comprises an undersurface, the method further comprising the step of forming a seal between the undersurface of the coating tray and the top cover of the roll enclosure.

* * * * *